US009795826B1

(12) United States Patent
Vardi

(10) Patent No.: US 9,795,826 B1
(45) Date of Patent: Oct. 24, 2017

(54) EXERCISE DEVICE

(71) Applicant: Navid Vardi, Lorton, VA (US)

(72) Inventor: Navid Vardi, Lorton, VA (US)

( * ) Notice: Subject to any disclaimer, the term of this patent is extended or adjusted under 35 U.S.C. 154(b) by 0 days.

(21) Appl. No.: 14/999,468

(22) Filed: May 12, 2016

(51) Int. Cl.
*A63B 21/072* (2006.01)
*A63B 21/00* (2006.01)
*A63B 23/12* (2006.01)

(52) U.S. Cl.
CPC ..... *A63B 21/4035* (2015.10); *A63B 23/1236* (2013.01)

(58) Field of Classification Search
USPC ..... 482/108
See application file for complete search history.

(56) References Cited

U.S. PATENT DOCUMENTS 660,962 A * 10/1900 Kennedy ..... A63B 21/0722 482/108
D244,628 S * 6/1977 Wright ..... D21/682
D267,737 S * 1/1983 Wright ..... D21/682
D363,752 S * 10/1995 Shumber ..... D21/682
5,716,305 A * 2/1998 Selsam ..... A63B 21/00047 482/106
7,014,598 B2 * 3/2006 Fenelon ..... A63B 21/075 482/106
D575,361 S * 8/2008 Davis ..... D21/682
D651,671 S * 1/2012 Ross ..... D21/662
8,231,511 B2 * 7/2012 Dalcourt ..... A63B 21/0607 482/106
D665,469 S * 8/2012 Zabel ..... D21/662
8,454,485 B1 * 6/2013 Hodes ..... A63B 21/0726 482/108
8,944,971 B2 * 2/2015 Shorter ..... A63B 21/072 482/107
D779,599 S * 2/2017 Jung ..... D21/681
9,573,014 B2 * 2/2017 Sorin ..... A63B 21/072

* cited by examiner

*Primary Examiner* — Stephen R Crow
(74) *Attorney, Agent, or Firm* — Thomas J. Wallen, P.E.; Attorney at Law LLC

(57) ABSTRACT

A solid exercise device is disclosed made from an egg-shaped body that includes first handles on both ends of the egg-shaped body, and second handles recessed within the solid body. One side of the egg-shaped solid body is made flat to prevent the solid body from rolling. The exercise device can be used with one or both hands. When the flat side of the egg-shaped body is adjacent a solid surface, such as the floor, the exercise device can be used as an aid for performing push-ups. The device is particularly well adapted for use in small spaces.

8 Claims, 6 Drawing Sheets

EXERCISE DEVICE

CROSS REFERENCE TO RELATED APPLICATIONS

None

STATEMENT REGARDING FEDERALLY SPONSORED RESEARCH OR DEVELOPMENT

Not Applicable

THE NAMES OF PARTIES TO A JOINT RESEARCH AGREEMENT

None

INCORPORATION-BY-REFERENCE OF MATERIAL SUBMITTED ON A COMPACT DISK

None

BACKGROUND OF THE INVENTION

Brief Summary of the Invention

An exercise device that assists with multiple types of exercise is disclosed. The device comprises an egg-shaped body including integral handles symmetrically located axially on both sides of the egg-shaped body, enabling two-hand use of the device. Recessed handles located in the center of the egg-shaped body enable the device to be used with one-hand. The egg-shaped body includes a flat side that prevents the device from rolling when the device is used as a ground support for exercises such as push-ups.

BRIEF DESCRIPTION OF THE VARIOUS FIGURES

DETAILED DESCRIPTION OF THE INVENTION

The invention is best described in relation to the various figures.

Figure 1:
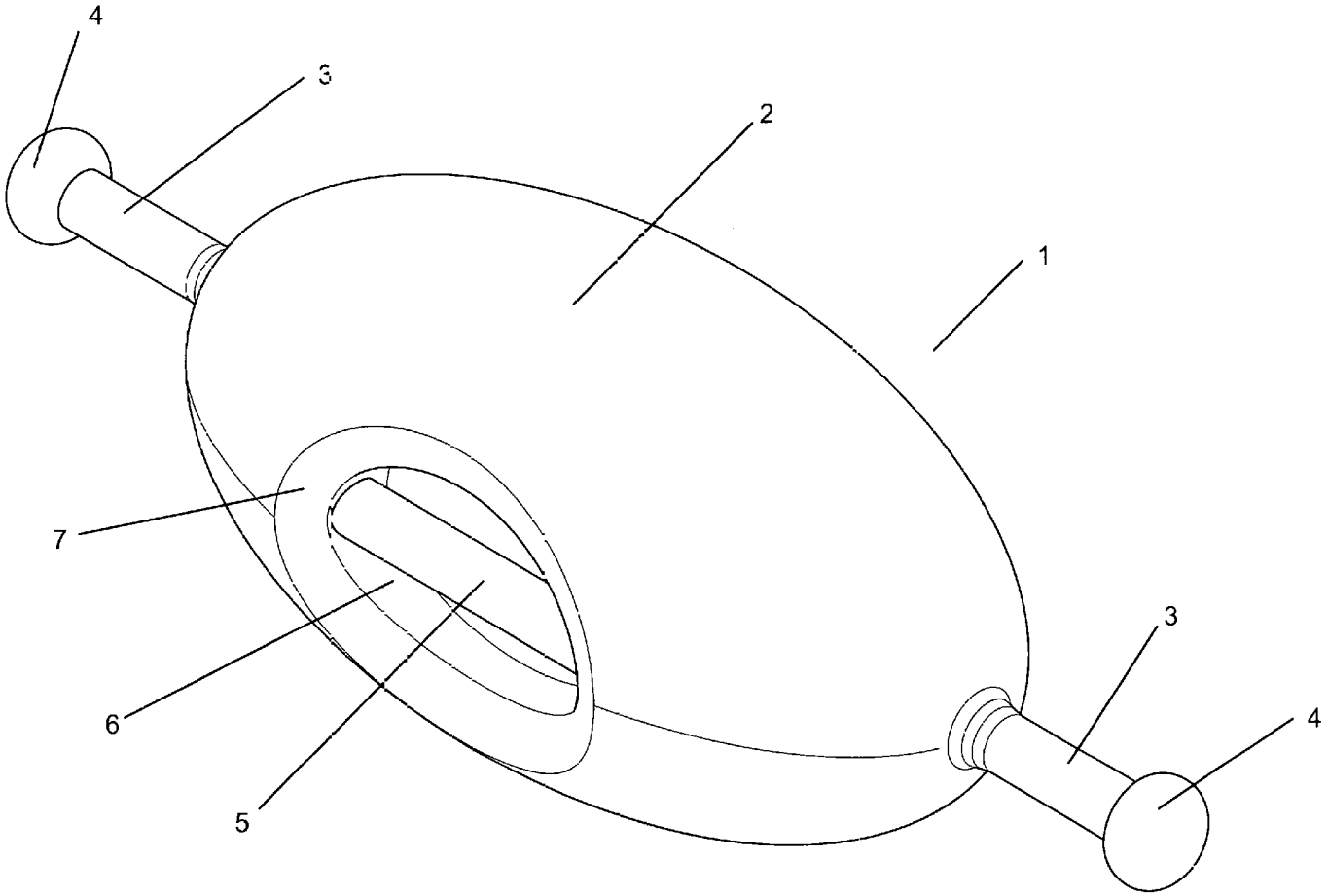
FIG. 1 shows the device in perspective with one recessed handle in the center of the egg-shaped body.

FIG. 1 shows the exercise device (1) in accordance with the instant invention in a perspective view. Egg-shaped body (2), an ellipsoidal solid body includes first handles (3) extending integrally from both ends of the egg-shaped body (2), and in axial alignment with the axis of symmetry of the ellipsoidal body (2). Recessed second handles (5) are located entirely interior and embedded below the surface of the ellipsoidal body (2) within recesses (6) and are recessed sufficiently that no part of the second handles (5) protrude outside of the recesses (6). It is important that there be no protrusion of handles (5) from outside of recesses (6). The inside circumference of recess (6) can be relieved as shown by surface (7), eliminating any sharp corner around the outside of the elliptical circumference of recess (6). Knobs (4) are located on the outer ends of first handles (3) and aid in holding the device. Knobs (4) are especially useful to prevent slippage when the user's hands are wet with sweat or other liquids. Second handles (3) and first handles (5) could of course be textured or overlaid with an abrasive surface to prevent slippage of first handles (3) and second handles (5). Knobs (4) are rounded, again to preclude sharp corners.

First handles (3) and recessed second handles (5) are normally round, but the invention is not limited to any particular shape of the first handles (3) and second handles (5). The important constraint is that there be no sharp corners about the first handles (3) or second handles (5). First handles (3) and second handles (5) are slender and sized to fit a user's hand. Preferably there is a void space between the second handles (5) and the solid body (2), the void space being large enough to accommodate the user's hand, such that the user can grasp the second handles (5) and wrap his hand completely around the second handles (5). This enables a firm, secure grip to the exercise device preventing accidental dropping or propelling of the device when it is in a dynamic use mode.

Figure 2:
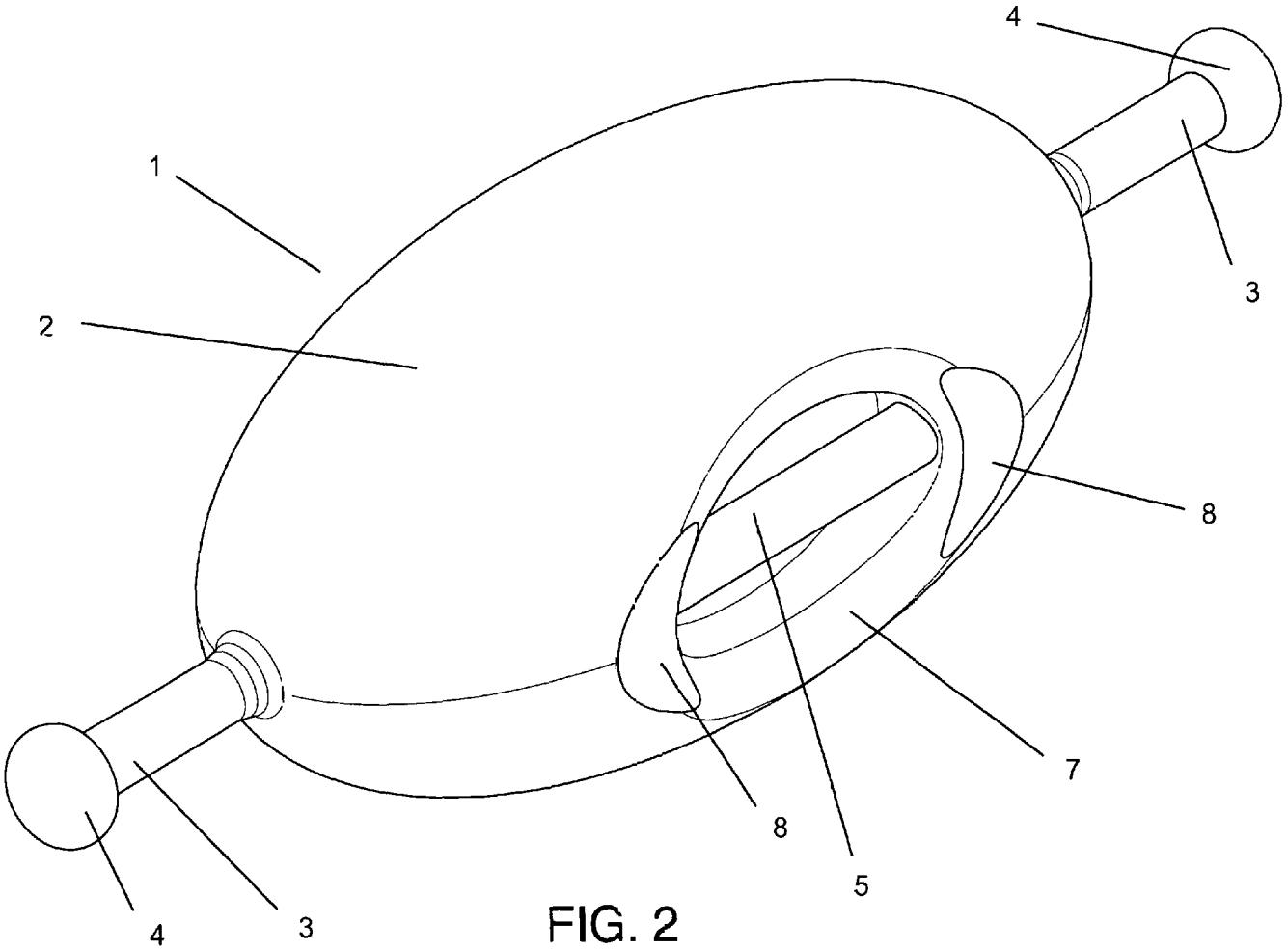
FIG. 2 shows an embodiment of the invention in perspective where a flat side is located over the recessed handle.

FIG. 2 shows the exercise device of the instant invention in perspective rotated 180 degrees from FIG. 1. Flat side (8) is located on both sides of recess (6). Flat side (8) prevents the exercise device (1) from rolling when flat side (8) contacts a flat surface, such as the floor of the location where exercise is being conducted. Flat side (8) can be increased in area until flat side (8) extends entirely around the outer circumference of recess (6), forming an elliptically shaped flat side. The important constraint is that second handles (5) remain embedded in recesses (6). Although in FIG. 1 and FIG. 2 only one side is flat, it is expressly understood that both recesses (6) could be provided with elliptically shaped flat sides (8).

Figure 3:
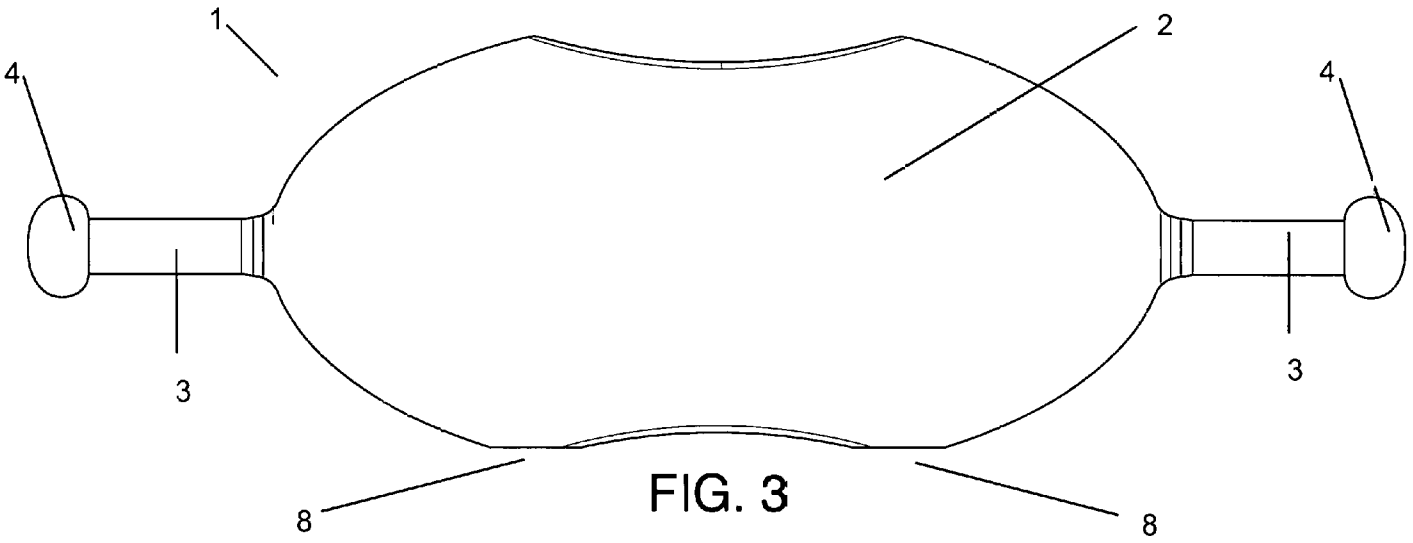
FIG. 3 shows the exercise device in profile with a flat side over one of the recessed handles.
Figure 4:
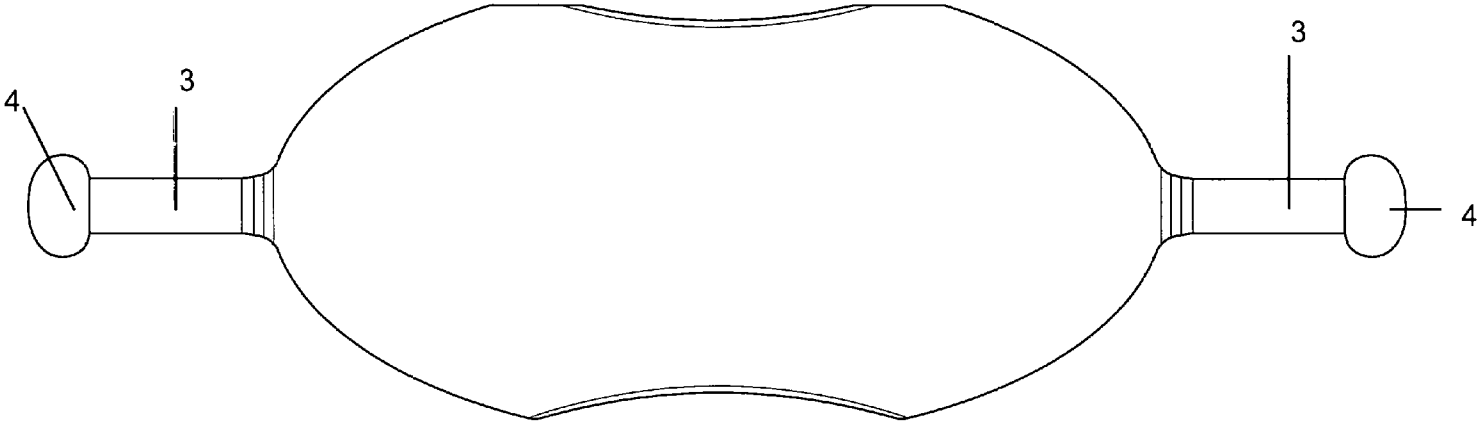
FIG. 4 shows the exercise device in profile rotated 180 degrees from FIG. 3.

FIG. 3 and FIG. 4 show the exercise device according to the invention as seen when looking down on the exercise device in profile. This view can be best defined as looking perpendicular to an imaginary plane that cuts simultaneously through the axis of symmetry of both first handles (3) and both second handles (5). Flat side (8) can be seen in both FIG. 3 and FIG. 4 on only one side. Again, it is contemplated that flat side (8) could equally be located on about both recesses (6).

Figure 5:
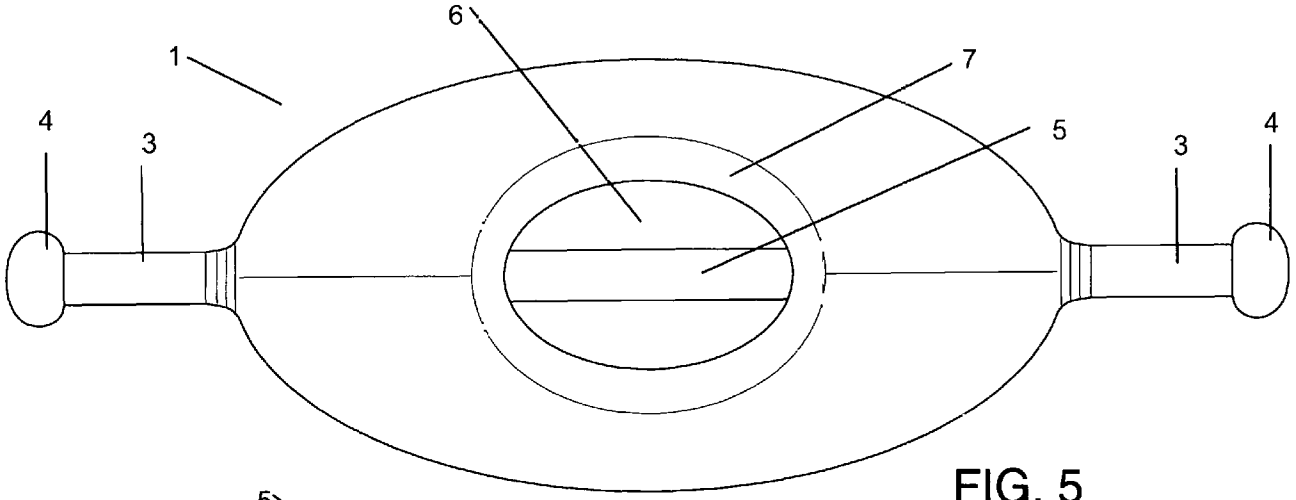
FIG. 5 shows the exercise device in horizontal revealing the first recessed handle.
Figure 6:
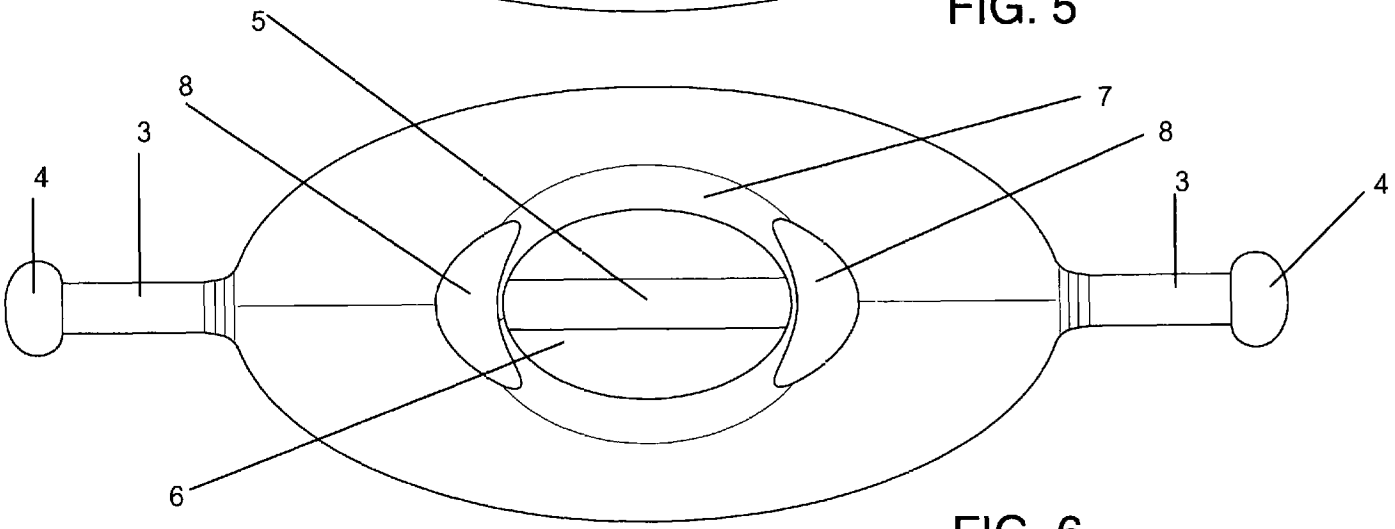
FIG. 6 shows the exercise device in horizontal rotated 180 degrees from FIG. 5 revealing a flat spot over the second recessed handle.
Figure 8:
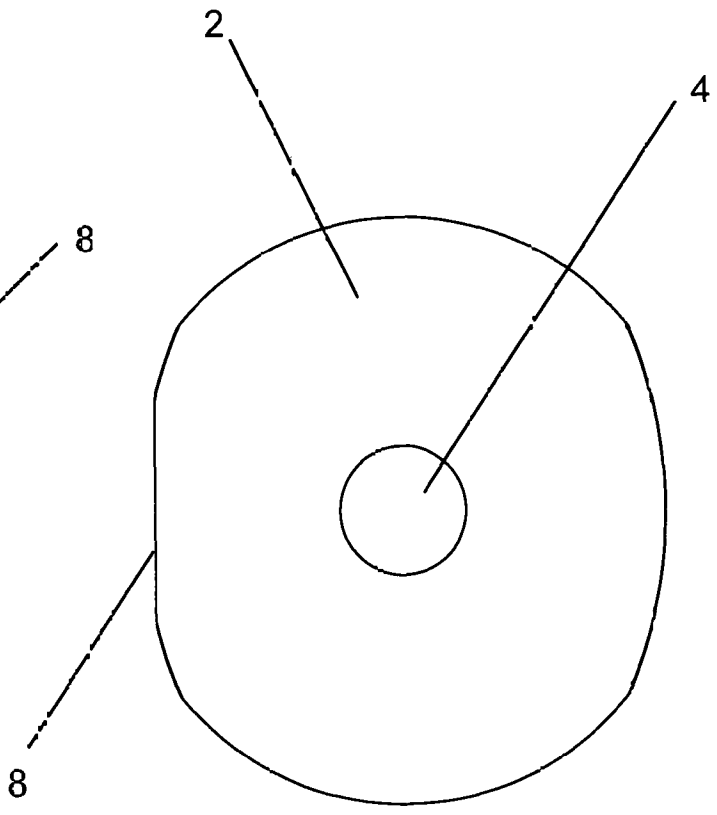
FIG. 8 shows the exercise device of FIG. 8 in profile rotated 180 degrees from FIG. 7.

FIG. 5 and FIG. 6 show the exercise device according to the invention in horizontal, here rotated 90 degrees from the position shown in FIG. 3 and FIG. 4. These views can be best defined as looking at the edge view an imaginary plane that cuts simultaneously through the axis of symmetry of both second handles (5). In FIG. 5 there is no flat side (8). Flat side (8) can be seen in Figure (6).

Figure 7:
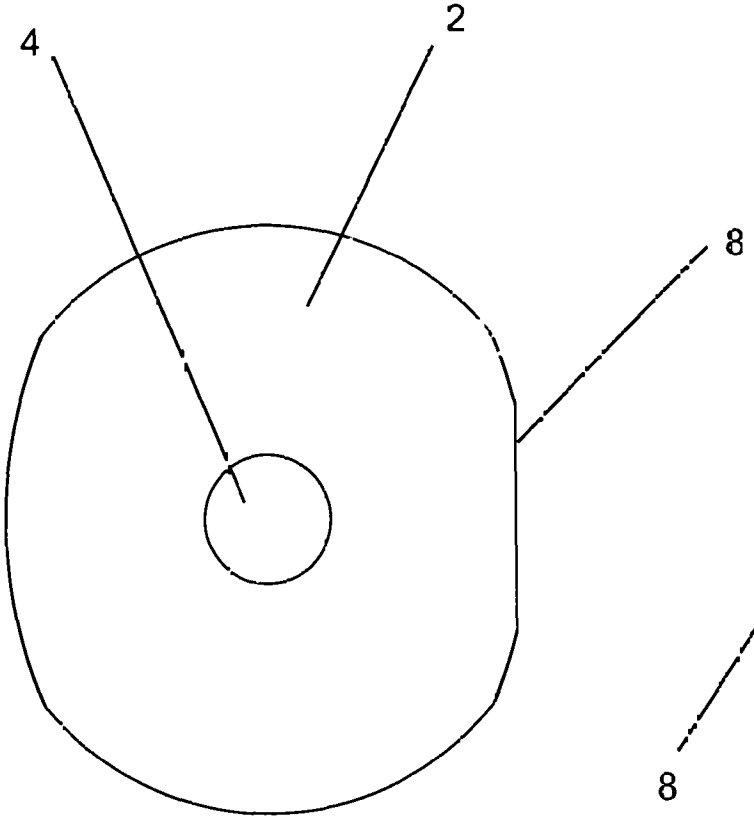
FIG. 7 shows the exercise device in profile as it appears in a plane perpendicular to the axis of symmetry, revealing the flat side located over the second recessed handle.

FIG. 7 shows the instant exercise device as seen in profile when viewed from the ends. This view is best described as looking down on an imaginary plane positioned perpendicular to the axis of symmetry that runs through second handles (5) and knobs (4). Flat side (8) is again seen on only one side overlying recess (6).

Figure 9:
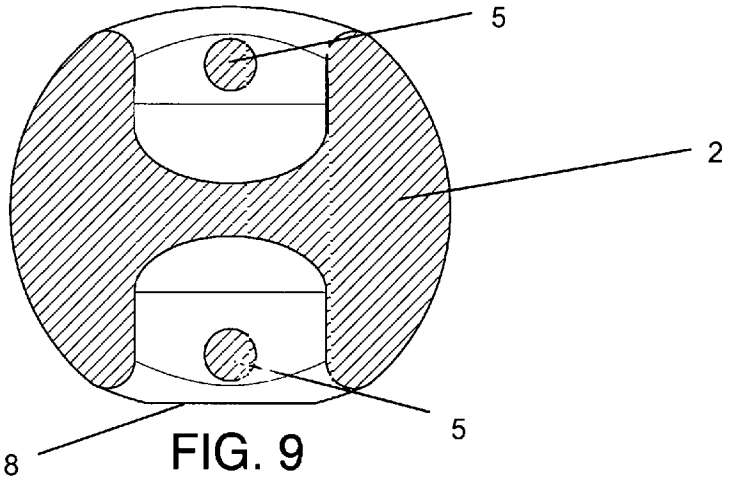
FIG. 9 shows a sectional view of the exercise device where the cutting plane is through the axis of symmetry and parallel to the recessed handles.

FIG. 9 shows the exercise device of the invention as seen in section with a cutting plane through the axis of symmetry of first handles (3) and knobs (4). Second handles (5) can be seen embedded within recess (6). Flat side (8) is provided overlying only one recess (6).

Figure 10:
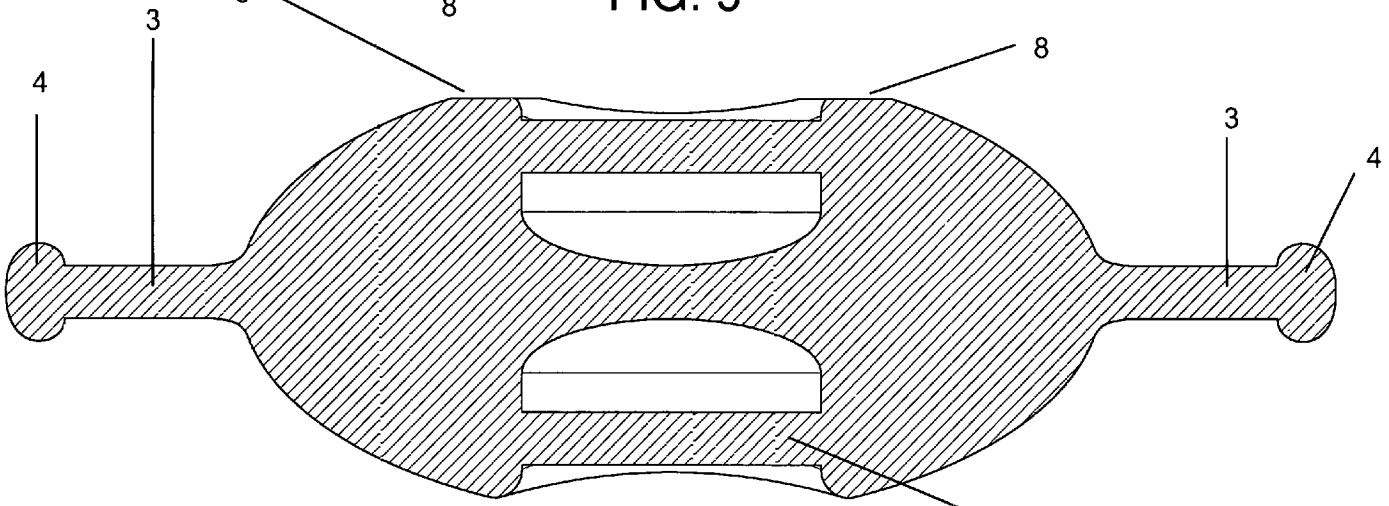
FIG. 10 shows a sectional view where the cutting plane is perpendicular to the axis of symmetry.

FIG. 10 shows the exercise device of the invention in section, where the cutting plane is perpendicular to the axis or symmetry of first handles (3). Recess (6) is visible, and of course second handles (5) appear in section as well. Flat side (8) is seen overlying one recess (6).

The exercise device according to the invention can be used in many ways. For instance, by grasping one of the second handles (5), the device can be used as a single-handed bar bell. Likewise the user can grasp first handle (3) and use the device with only one arm. The user can rotate the exercise device in any manner his arm is capable of. Alternatively, the user can grasp the device with both first handles (3) and operate the exercise device in the manner usually associated with a double-handled bar bell. The exercise device could be used in a standing position, or equally the exercise device could be used from a lying or sitting position. Because the device has two sets or handles, first handles (3) on the ends and second handles (5) recessed in the interior of egg-shaped body (2), the exercise device exhibits dual functions, i.e. both as a single-handed and double-handed device.

Flat side (8) allows the device to rest on a flat surface, such as the floor of the exercise area. When exercise device (1) is in a resting position on the floor, the user can grasp both first handles (3), one in each hand, and use the exercise device to assist in performing push-ups. Advantageously, flat side (8) could be textured or provided with an abrasive surface to prevent the exercise device from sliding along the floor when force from the user is transmitted through the device, such as when the user is performing sit up exercises.

It is contemplated that the exercise device of the invention be provided in different lengths and weights. Weights from 10 pounds to 100 pounds are especially preferred, although it is expressly understood that the invention is not limited by length or weight. When the device increases in weigh, it is contemplated that the length will correspondently increase. In this manner, the thickness of egg-shaped body (2) will not become excessive. For instance, the exercise device could be provided with weights incrementally increasing by 5 pounds from 10 to 25 pounds, each having a length of 28 Inches. For increments of 30 pounds to 45 pounds, the length would increase. It is envisioned that increments of 10-25 pounds, 30-45 pounds, 50-65 pounds, 70-85 pounds, and 90-100 pounds would be especially valuable. Again, the length increases with each increment, or with each weight within each increment. The important consideration is that the width of the egg-shaped body (2) remains manageable as the weight of exercise device (1) increases.

The exercise device (1) is preferably one-piece, either machined or injection molded. Alternatively, first handles (3) could be integrally attached to egg-shaped body (2). Suitable materials of construction would include injection molded thermoplastics, or cast or machined metals. Wood is an appropriate material, for all or part of the device. It is understood that the entire exercise device need not be manufactured from a single material. For instance, the egg-shaped body (2) could be wood and the first handles (3) could be polymeric or metallic. However, recessed second handles (5) are most conveniently injection molded or otherwise case in one-piece with egg-shaped body (2).

Because the exercise device is capable of functioning in the dual role or single-handed and two-handed operation, the exercise device inherently saves storage space. For this reason, it is particularly well adapted for use by individuals with limited space, such as college students in a dormitory, or sailors at sea.

It is well known that astronauts must exercise regularly in zero gravity, or muscular atrophy onsets quickly. The instant exercise device of the invention is readily adaptable to space travel because of its multifunctional nature. When manufacturing a device for space travel, the recessed portion (6) could be exaggerated to accommodate gloves as worn my astronauts.

The invention claimed is:

1. An exercise device comprising a solid body having a longitudinal axis of symmetry, with two recessed faces on opposite sides of the solid body, including two first handles extending from both ends of the solid body and sharing the longitudinal axis of symmetry with the solid body, and wherein the first handles are adapted for holding the exercise device by the first handles, such that the first handles can be held with one or two hands of a user, and two second handles located within the recessed faces on opposite sides of the solid body, such that the user can grasp the exercise device by the second handles by placing his hand within the recesses and grasping the device.

2. The exercise device of claim 1 further including two knobs integrally located on the outer ends of the two first handles and sharing the longitudinal axis of symmetry with the two first handles.

3. The exercise device of claim 1 wherein one of the recesses in the solid body includes a flat side such that the exercise device is incapable of rolling on a flat surface.

4. The exercise device of claim 1 wherein the solid body is in the shape of an ellipsoid.

5. The exercise device of claim 1 wherein the first handles and the second handles are round.

6. The exercise device of claim 2 wherein the two knobs are round.

7. The exercise device of claim 1 wherein there is a void space between the second handles and the solid body, the void space being large enough to accommodate the user's hand, such that the user can grasp the second handles and wrap his hand completely around the second handles.

8. The exercise device of claim 1 wherein the first handles and second handles are textured.

* * * * *